US007484647B2

(12) United States Patent
Yang

(10) Patent No.: US 7,484,647 B2
(45) Date of Patent: Feb. 3, 2009

(54) NAIL GUN WITH A SAFETY ASSEMBLY

(75) Inventor: Brad Yang, Tali (TW)

(73) Assignee: Testo Industry Corp., Tali, Taichun Hsien (TW)

( * ) Notice: Subject to any disclaimer, the term of this patent is extended or adjusted under 35 U.S.C. 154(b) by 60 days.

(21) Appl. No.: 11/757,903

(22) Filed: Jun. 4, 2007

(65) Prior Publication Data

US 2008/0296337 A1 Dec. 4, 2008

(51) Int. Cl.
*B27F 7/05* (2006.01)

(52) U.S. Cl. ..... 227/8; 227/129; 227/130

(58) Field of Classification Search ..... 227/8, 227/129, 130

See application file for complete search history.

(56) References Cited

U.S. PATENT DOCUMENTS 3,612,379 A * 10/1971 Panock ..... 227/8
3,762,620 A * 10/1973 Geist ..... 227/8
3,905,535 A * 9/1975 Novak et al. ..... 227/120
4,260,092 A * 4/1981 Austin ..... 227/8
4,405,071 A * 9/1983 Austin ..... 227/7
4,549,344 A * 10/1985 Nikolich ..... 29/432
4,566,619 A * 1/1986 Kleinholz ..... 227/8
4,821,937 A * 4/1989 Rafferty ..... 227/8
4,928,868 A * 5/1990 Kerrigan ..... 227/131
5,035,354 A * 7/1991 Meyer ..... 227/7
5,261,587 A * 11/1993 Robinson ..... 227/8
5,437,339 A * 8/1995 Tanaka ..... 173/210
5,836,501 A * 11/1998 Lai ..... 227/8
5,996,874 A * 12/1999 Fukushima et al. ..... 227/8
6,357,647 B1 * 3/2002 Ou ..... 227/8
6,588,642 B1 * 7/2003 Wang et al. ..... 227/8
6,641,018 B2 * 11/2003 Akiba ..... 227/8
6,763,992 B2 * 7/2004 Hirai ..... 227/142
6,820,788 B2 * 11/2004 Akiba ..... 227/8
6,857,547 B1 * 2/2005 Lee ..... 227/8
RE38,834 E * 10/2005 Perra ..... 173/8
6,974,062 B2 * 12/2005 Akiba ..... 227/8
7,150,384 B2 * 12/2006 Yasuike et al. ..... 227/8
7,213,733 B1 * 5/2007 Wen ..... 227/8
7,255,326 B2 * 8/2007 Wang ..... 251/234
7,389,901 B2 * 6/2008 Cho et al. ..... 227/8
2005/0127127 A1 * 6/2005 Huang ..... 227/8
2006/0255085 A1 * 11/2006 Wen ..... 227/8
2007/0170222 A1 * 7/2007 Bromley et al. ..... 227/8

* cited by examiner

*Primary Examiner*—Rinaldi I. Rada
*Assistant Examiner*—Gloria R. Weeks
(74) *Attorney, Agent, or Firm*—patenttm.us

(57) ABSTRACT

A nail gun has a body, a breach assembly, a triggering device, a safety assembly and a magazine. The safety assembly has a safety lever and an activating beam, both of which are required to be activated to selectively engage the triggering device to allow the nail gun to perform a nailing cycle. When the nail gun is operated incorrectly, the safety assembly does not engage the triggering mechanism so the nail gun is prevented from performing the nailing cycle. The magazine is mounted in the breach assembly and feeds fastening devices into the breach.

4 Claims, 8 Drawing Sheets

NAIL GUN WITH A SAFETY ASSEMBLY

BACKGROUND OF THE INVENTION

1. Field of the Invention

The present invention relates to a nail gun, and more particularly relates to a nail gun with a safety assembly that allows the nail gun to operate safely and conveniently.

2. Description of Related Art

Conventional nail guns have a handle and are used to drive fastening devices in a variety of applications, including home refurbishing shoemaking, leatherwear and such like.

When the nail gun is activated, the fastening device is shot from the conventional nail gun at a high speed. This may be dangerous if the nail gun is accidentally activated. Some safety assemblies are not fully integrated into the nail gun so are easily removed at the detriment of safety.

To overcome the shortcomings, the present invention provides a nail gun with a safety assembly to mitigate or obviate the aforementioned problems.

SUMMARY OF THE INVENTION

The main objective of the present invention is to provide a nail gun with a safety assembly that allows the nail gun to be operated safely and conveniently.

The nail gun has a body, a breach assembly, a triggering device, a safety assembly and a magazine. The safety assembly comprises a safety lever and an activating beam, both of which are required to be activated to selectively engage the triggering device to allow the nail gun to perform a nailing cycle. When the nail gun is operated incorrectly, the safety assembly does not engage the triggering mechanism so the nail gun is prevented from performing the nailing cycle. The magazine is mounted in the breach assembly, and feeds fastening devices into the breach.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
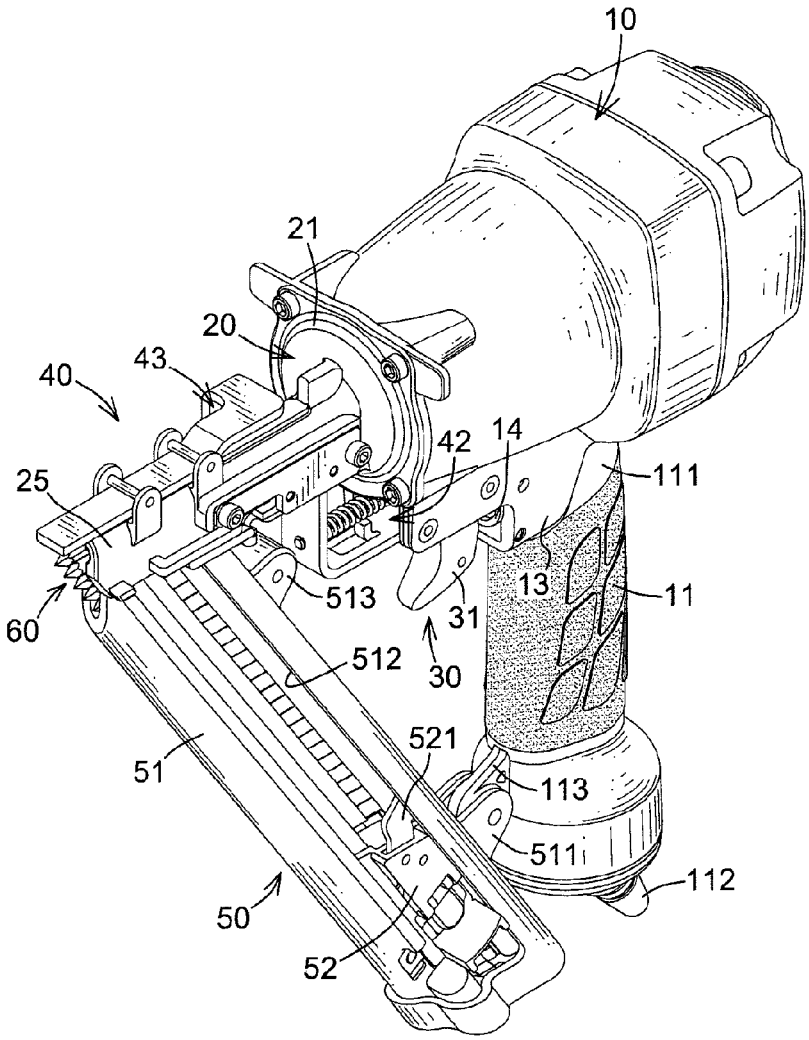
FIG. 1 is a perspective view of a nail gun with a safety assembly in accordance with the present invention.

With reference to FIG. 1, a nail gun with a safety assembly in accordance with the present invention is used with fastening devices (60) that may be nails, staples or such like and comprises a body (10), a breach assembly (20), a triggering device (30), a safety assembly (40), and a magazine (50).

Figure 3:
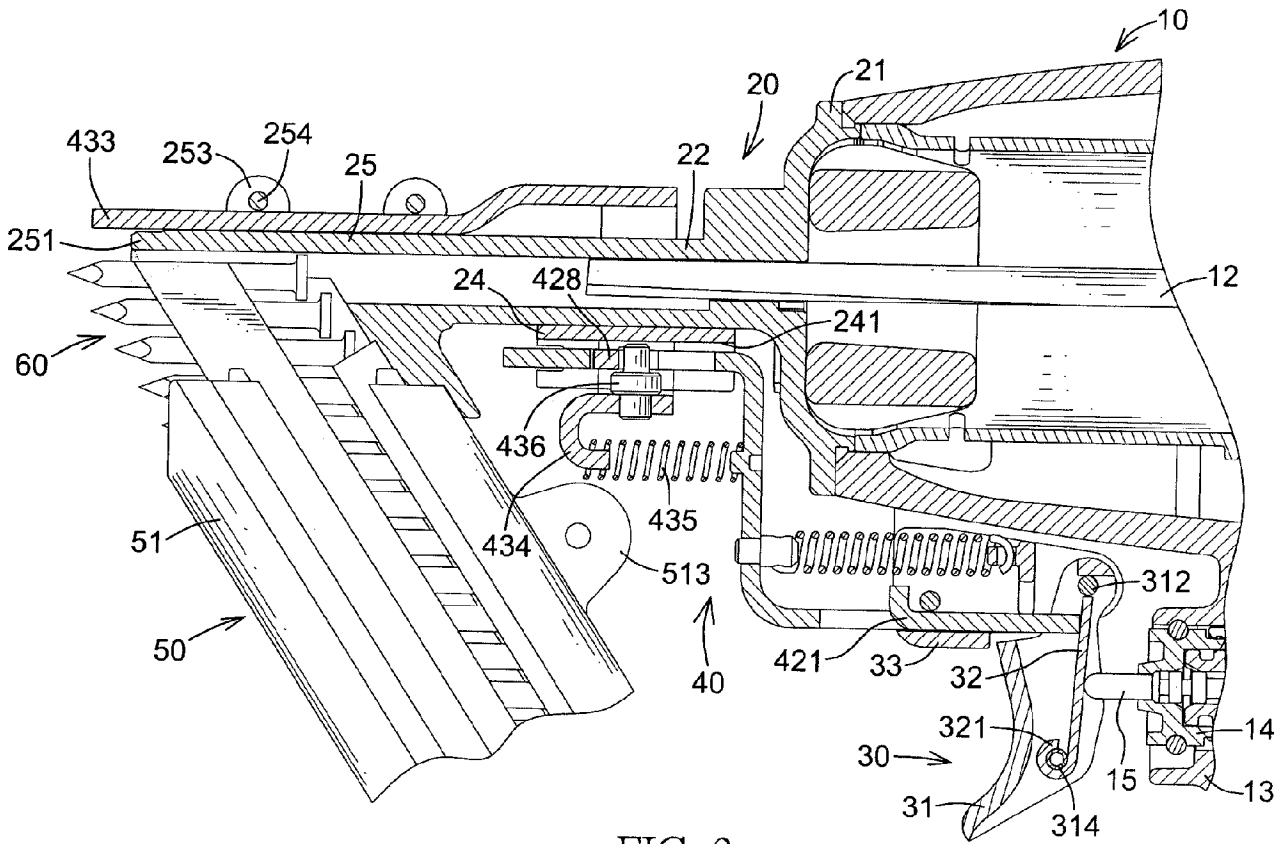
FIG. 3 is an enlarged side view in partial section of the nail gun in FIG. 1.

With further reference to FIG. 3, the body (10) has a front, a handle (11), a chamber, a drive device, a plunger (12), a trigger mounting bracket (13), a trigger switch (14) and an actuator (15).

The handle (11) is defined on and protrudes transversely from the body (10) and has an external surface, a trigger end (111), a power supply end (112) and an optional magazine mount (113). The trigger end (111) is formed adjacent to the body (10). The power supply end (112) is connected to a power supply, wherein the power supply provides compressed gas or electricity and may be a compressor, a gas cylinder, an electric cable, a battery pack or the like. The magazine mount (113) is formed on the external surface of the handle (11) near the power supply end (112).

The chamber is defined longitudinally inside the body (10) and communicates with the power supply end (112) of the handle (11).

The drive device is mounted in the chamber of the body (10) and is connected to the power supply.

The plunger (12) is connected to the drive device and mounted slidably in the chamber and has an outer end extending out of the body (10).

Figure 2:
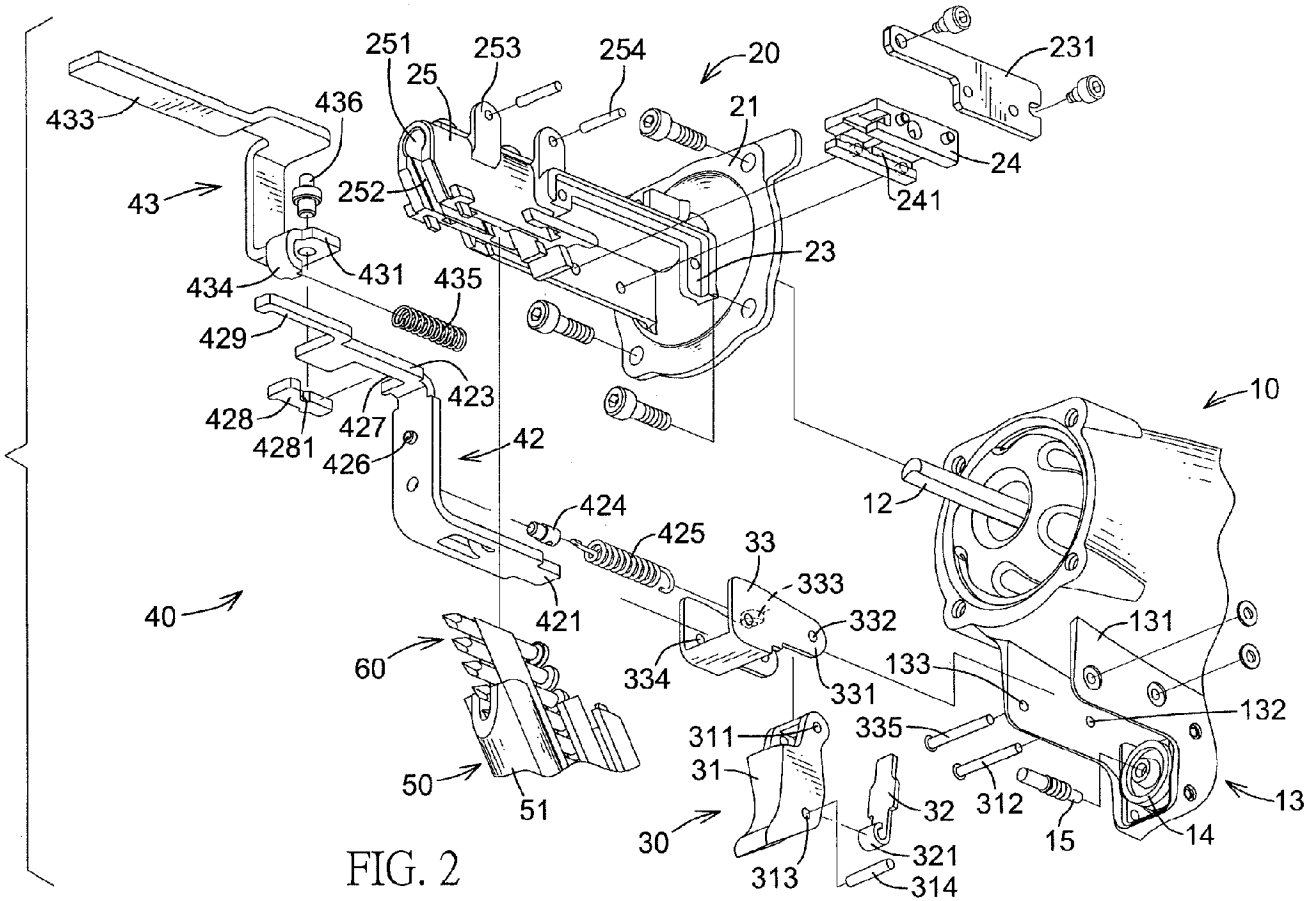
FIG. 2 is an exploded perspective view of the nail gun in FIG. 1.

With further reference to FIG. 2, the trigger mounting bracket (13) is formed on, protrudes from and connects to the body (10) and has two sidewalls (131), two mounting holes (133) and two pivot rod holes (132). The mounting holes (133) are formed through the sidewalls (131) and align with each other. The pivot rod holes (132) are formed through the sidewalls (131) of the trigger mounting bracket (13) near the handle (13) and align with each other.

The trigger switch (14) is mounted in the trigger mounting bracket (13), is connected to the drive device and has a central hole.

The actuator (15) is movably mounted in the central hole of the trigger switch (14). When the actuator (15) is in a default position, the trigger switch (14) is off, and the nail gun cannot be activated. When, the actuator (15) moves into the central hole of the trigger switch (14), the trigger switch (14) is turned on, and the nail gun may begin a nailing cycle.

The breach assembly (20) is connected securely to the front of the body (10) and has a mounting bracket (21), a barrel (22), two breach brackets (23), a tracking mount (24) and a breach (25).

The mounting bracket (21) is attached securely to the front end of the body (10) by multiple fasteners. The barrel (22) is hollow, is formed on and protrudes from the mounting bracket (21) and has a through hole, a proximal end and a distal end. The proximal end of the barrel (22) is connected to the mounting bracket (21).

The breach brackets (23) are formed on, protrude from and connect to the barrel (22) and the mounting bracket (21) and each breach bracket (23) has a rear end formed on the mounting bracket (21) beside the barrel (22), a front end and a service cover (231).

The service cover (231) is detachably mounted to the breach bracket (23). The tracking mount (24) is attached securely to the breach bracket (23), adjacent to the barrel (22) and has an inner track (241) formed longitudinally on the tracking mount (24).

The breach (25) may be an inverted U shape, is formed on and protrudes from the barrel (22) and the breach brackets (23) and has an external surface, a bottom, a top, an ejection hole (251), a breach groove (252), multiple guiding cylinder mounts (253) and multiple guiding cylinders (254).

The ejection hole (251) is defined through the breach (25) and communicates concentrically with the barrel (22) and mounted around the outer end of the plunger (12).

The breach groove (252) is formed parallel with and through the bottom of the breach (25), communicates with the ejection hole (251) and is used to feed the fastening devices (60) into the ejection hole (251) of the breach (25).

The guiding cylinder mounts (253) are formed on and protrude from the external surface near the top of the breach (25) in pairs and each pair are aligned longitudinally on the breach assembly (20). The guiding cylinders (254) are respectively attached transversely between two corresponding guiding cylinder mounts (253) at the top of the breach (25).

The triggering device (30) is mounted in the trigger mounting frame (13) and is used to activate the trigger switch (14) and has a trigger cover (33), a trigger (31), and a trigger arm (32).

The trigger cover (33) may be U shaped, is mounted securely between the sidewalls (131) of the trigger mounting bracket (13) adjacent to the trigger (31) and has a bottom, a front, a rear, two protrusions (331), two pivot rod holes (332), a through hole, a spring mounting protrusion (333), two mounting holes (334) and a mounting rod (335).

The rear is defined adjacent to the trigger switch (14) and has an inner surface.

The rear protrusions (331) are formed on and protrude from the outer surface of rear of the trigger cover (33). The pivot rod holes (332) are formed through the protrusions (331) of the trigger cover (33) and align with each other. The through hole is formed through the rear of the trigger cover (33). The spring mounting protrusion (333) is formed on and protrudes from the inner surface of the rear of the trigger cover (33).

The mounting holes (334) are respectively formed through the front of the trigger cover (33), are aligned with the mounting holes (133) in the sidewalls (131) of the trigger mounting bracket (13). The mounting rod (335) is mounted securely through the mounting holes (334) of the trigger cover (33) and the mounting holes (133) of the trigger mounting bracket (13).

The trigger (31) is pivotally mounted in the trigger mounting bracket (13) and aligns with the actuator (15), and has a pivotal end, a distal end, an internal chamber, two pivot rod holes (311), a pivot rod (312), a distal pin hole (313) and a pivot pin (314).

The pivot rod holes (311) are formed transversely through the trigger (31) at the pivotal end and align with the corresponding pivot rod holes (132) in the sidewalls (131) of the mounting bracket (13). The pivot rod (312) is mounted pivotally through the pivot rod holes (132) of the trigger mounting bracket (13), the pivot rod holes (332) of the trigger cover (33) and the pivot rod holes (311) of the trigger (31).

The distal pin holes (313) are formed transversely through the trigger (31) at the distal end. The pivot pin (314) is mounted transversely in the distal pin holes (313) in the internal chamber of the trigger (31).

The trigger arm (32) is pivotally connected to the pivot pin (314) in the internal chamber of the trigger (31 and has a neck and a gudgeon (321). The neck abuts the actuator (15). The gudgeon (321) is formed on and protrudes from the neck of the trigger arm (32) and is mounted around the pivot pin (314) of the trigger (31).

The safety assembly (40) is slidably mounted on the breach assembly (20) and connected to the triggering device (30) and has a transmitting beam (42) and an activating bracket (43).

The transmitting beam (42) is slidably mounted in the trigger cover (33) and the tracking mount (24) and has an inner surface, an outer surface, an anchor bolt (424), a transmitting spring (425), a spring mount (426), a trigger end (421) and a tracking end (423).

The anchor bolt (424) is connected to the transmitting beam (42) on the inner surface and faces the spring mounting protrusion (333) of the trigger cover (33).

The transmitting spring (425) is attached between the anchor bolt (424) of the transmitting beam (42) and the spring mounting protrusion (333) of the trigger cover (33).

The spring mount (426) is formed on the outer surface of the transmitting beam (42) above the anchor bolt (424).

The trigger end (421) is formed on and protrudes perpendicularly from the inner surface of the transmitting beam (42) and is mounted slidably in the trigger cover (33) between the mounting rod (335) and the bottom of the trigger cover (33), and extends through the through hole of the trigger cover (33) and abuts the neck of the trigger arm (32).

The tracking end (423) is formed on and protrudes perpendicularly from the outer surface of the transmitting beam (42), is slidably mounted in the inner track (241) of the tracking mount (24) and has a distal end, a safety recess (427), a safety lever (428) and an optional limiting arm (429).

The safety recess (427) is formed in the tracking end (423) of the transmitting beam (42) and communicates with the inner track (241) of the tracking mount (24).

The safety lever (428) is mounted in the tracking mount (24) between the inner track (241) and the safety recess (427) and has a switch recess (4281).

The switch recess (4281) is formed through the safety lever (428) and communicates with the safety recess (427).

The limiting arm (429) is formed on and protrudes from the distal end of the tracking end (423), extends out the service cover (231) and aligns with the external surface of the breach (25) near the bottom to form a limiting hole.

The activating bracket (43) is mounted slidably between the guiding cylinders (254) and the top of the breach (25) and has a mounting end, a connecting bracket (431), a spring hook (434), a minor spring (435), a safety switch (436) and an abutting beam (433).

The connecting bracket (431) is formed on and protrudes from the mounting end of the activating bracket (43) and is slidably mounted around the barrel (22) and connected to the tracking mount (24).

The spring hook (434) is formed on and protrudes from the connecting bracket (431) and aligns with the spring mount (426) on the transmitting beam (42).

The minor spring (435) is connected to the connecting bracket (431) and the transmitting beam (42) between the spring hook (434) and the protruding spring mount (426).

The safety switch (436) is rotatably mounted in the connecting bracket (431) and to the spring hook (434), between the switch recess (4281) of the safety lever (428) and the safety recess (427) of the transmitting beam (42).

The abutting beam (433) is formed on and protrudes from the active end of the activating bracket (43), and is connected to the connecting bracket (431) above the breach (25) and extends between the guiding cylinders (254) and the top of the breach (25) and has an active end that extends past the breach (25).

The magazine (50) is connected to the breach assembly (20), and is used to feed fastening devices (60) into the breach (25) and has a magazine frame (51) and a magazine follower (52). The magazine frame (51) is detachable connected to the breach (25) and has a bottom, a top, two optional mounting wings (511), a magazine guide groove (512) and a magazine spring (513). The top of the magazine frame (51) is mounted in the bottom of the breach (25). The mounting wings (511) are formed on the magazine frame (51) near the bottom and align with the magazine mount (113) of the handle (11). The magazine guide groove (512) is formed in the magazine frame (51) from the bottom to the top and communicates with the breach groove (252) in the breach (25) and holds the fastening devices (60) in the magazine frame (51). The magazine follower (52) is mounted slidably in the magazine guide groove (512) of the magazine frame (51) and connected to the magazine spring (513) that pushes the magazine follower (52) and feeds the fastening devices (60) into the breach groove (252) and has a top end and an optional positive stop (521). The positive stop (521) is formed on the top of the magazine follower (52) and aligns with the limiting hole between the limiting arm (429) and the breach (25).

Figure 7:
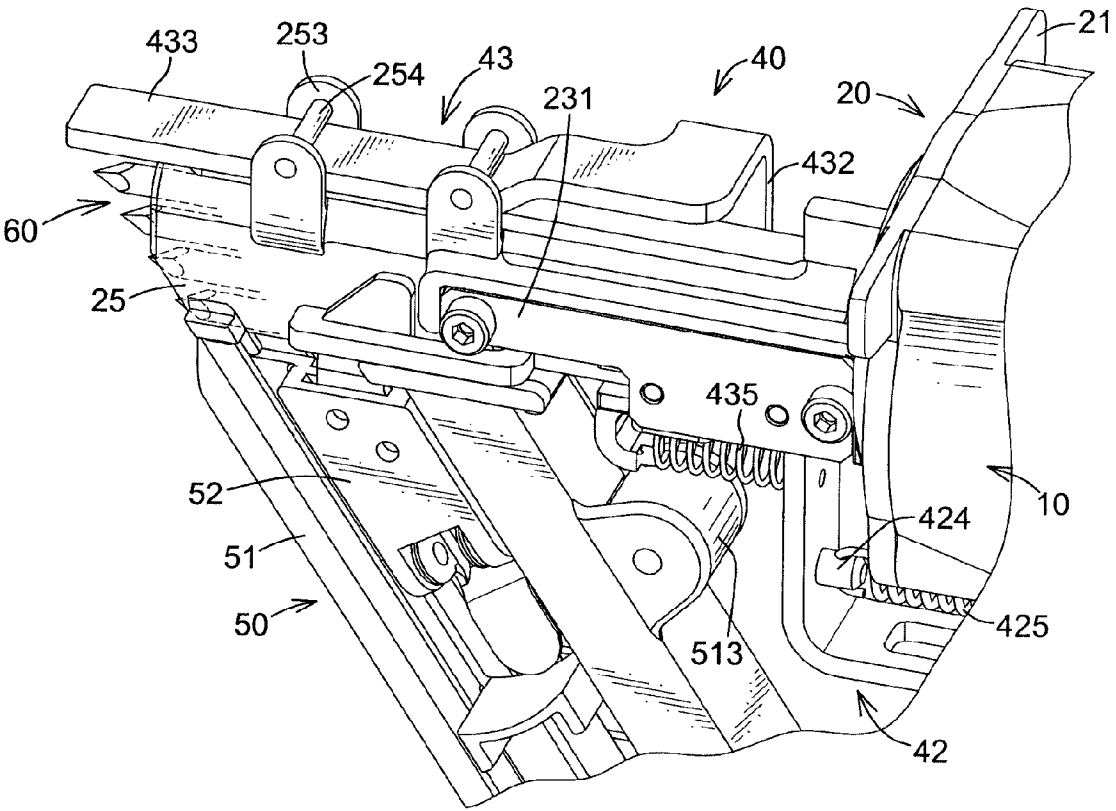
FIG. 7 is an enlarged perspective view of the nail gun in FIG. 1.
Figure 8:
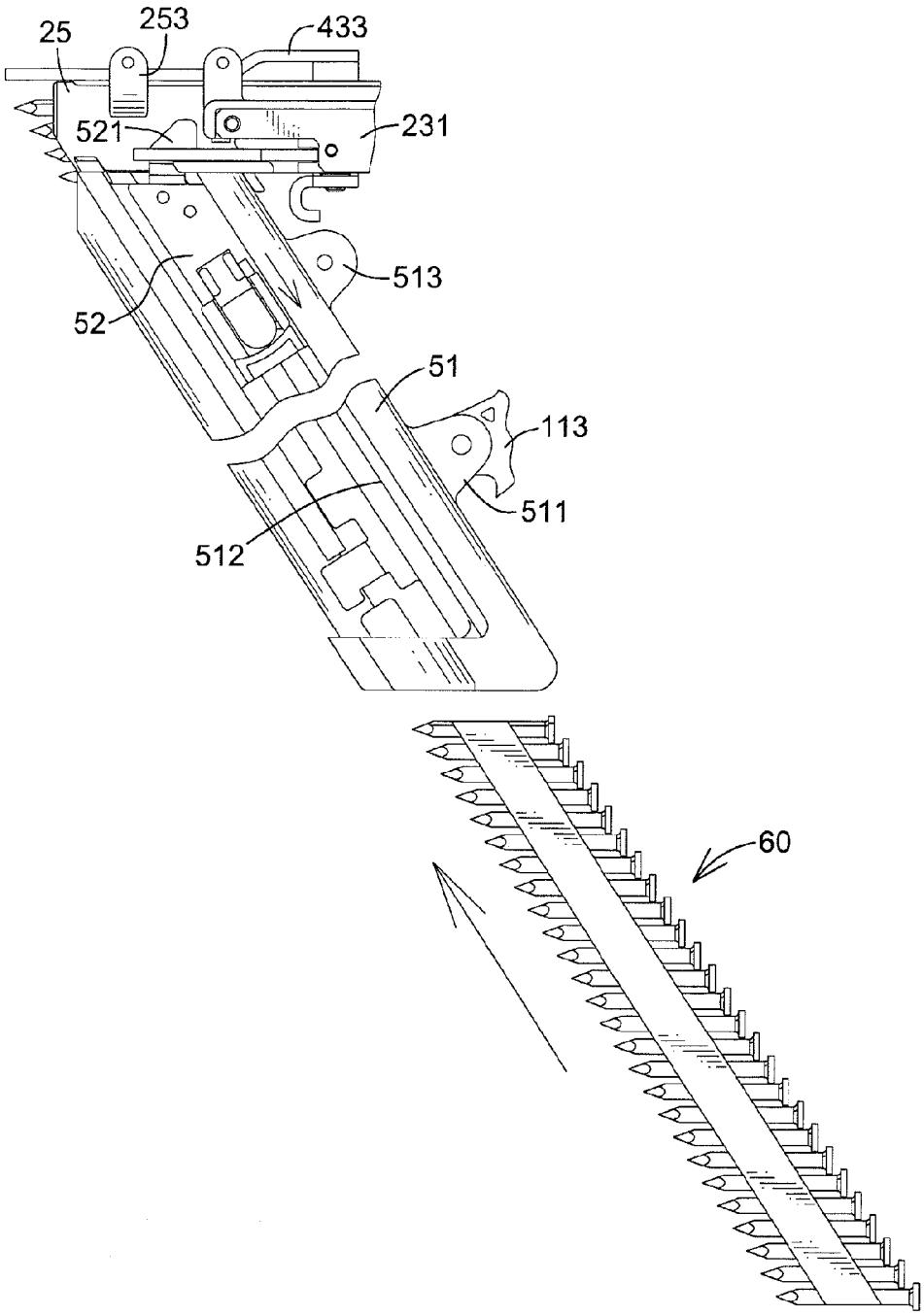
FIG. 8 is an operational side view of the nail gun in FIG. 1 showing fastening devices being fed into a magazine.

With reference to FIGS. 7 and 8, when four fastening devices (60) remain in the magazine guide groove (512), the positive stop (521) will engage with the limiting hole and the magazine follower (52) cannot push the fastening devices (60) into the breach groove (252). This reminds a person to feed new fastening devices (60) into the magazine guide groove (512) and align the new fastening devices (60) whilst four fastening devices (60) remain in the magazine guide groove (512). After feeding the fastening devices (60) into the magazine guide groove (512), the person pulls the magazine follower (52) down to the bottom of the magazine frame (51) to push the new fastening devices (60) into the breach groove (252.

Figure 4:
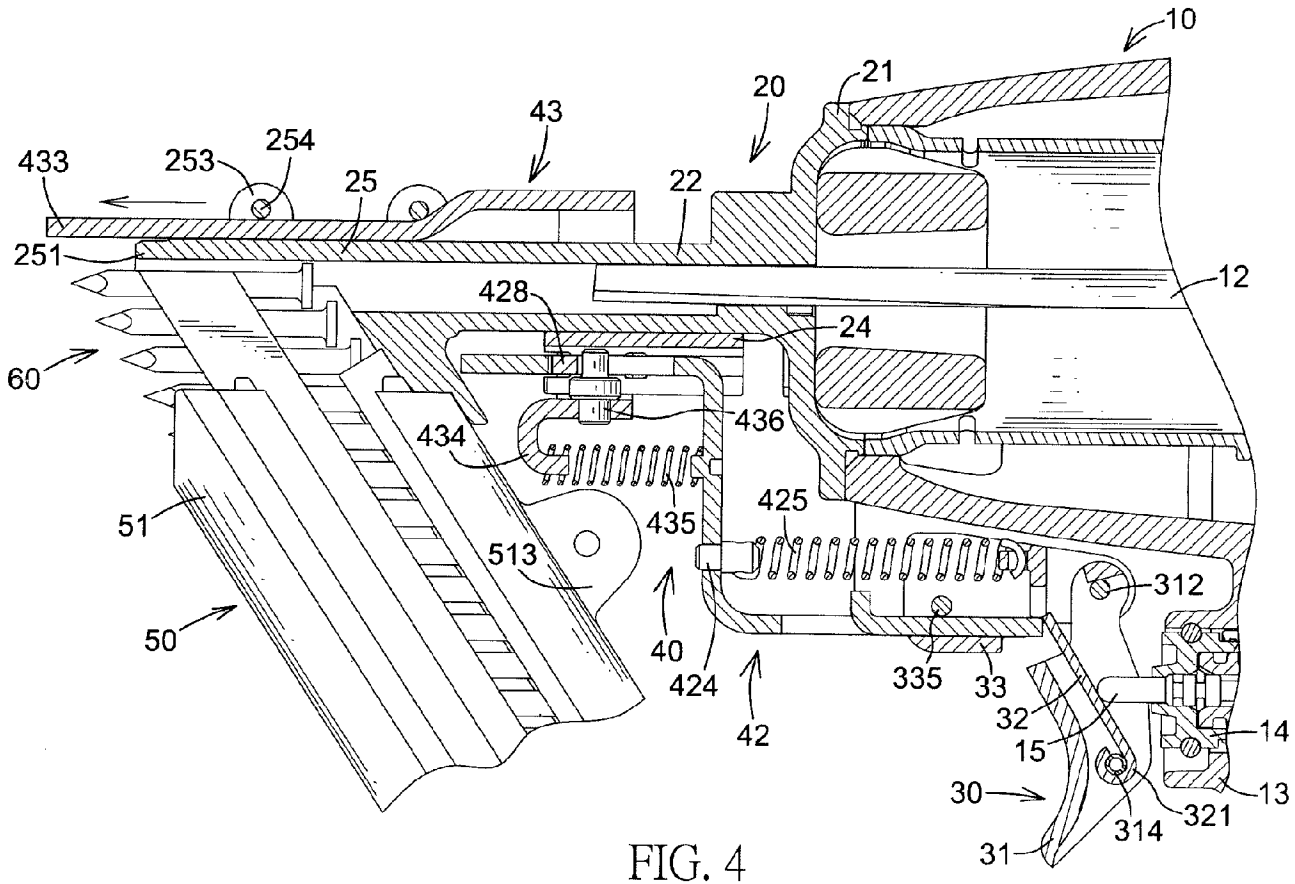
FIG. 4 is an operational side view in partial section of the nail gun in FIG. 1 not in contact with a work surface.

With further reference to FIG. 4, when the trigger (31) is pressed with the transmitting beam (42) in a default position, the neck of the trigger arm (321) does not abut the trigger end (421) of the transmitting beam (42) so the trigger arm (321) does not press the actuator (15) and the nail gun does not perform the nailing cycle.

Figure 5:
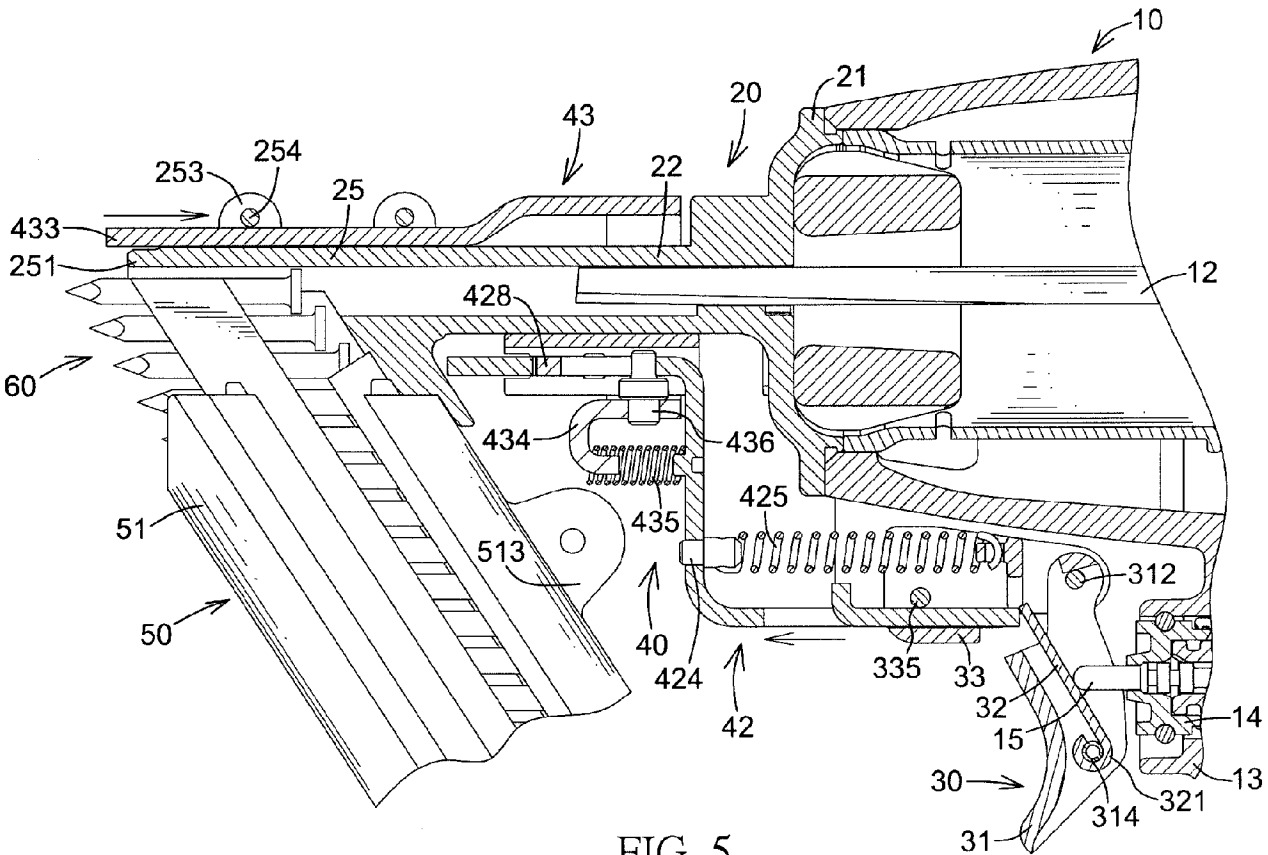
FIG. 5 is another operational side view in partial section of the nail gun in FIG. 1.

With further reference to FIG. 5, when the safety lever (428) is not engaged, if the abutting beam (433) is pressed against a working surface, the activating bracket (43) slides back but does not engage the transmitting beam (42) so the nail gun cannot perform the nailing cycle. When the nail gun is moved away from the working surface the minor spring (435) pushes the activating bracket (43) back to a default position.

Figure 6:
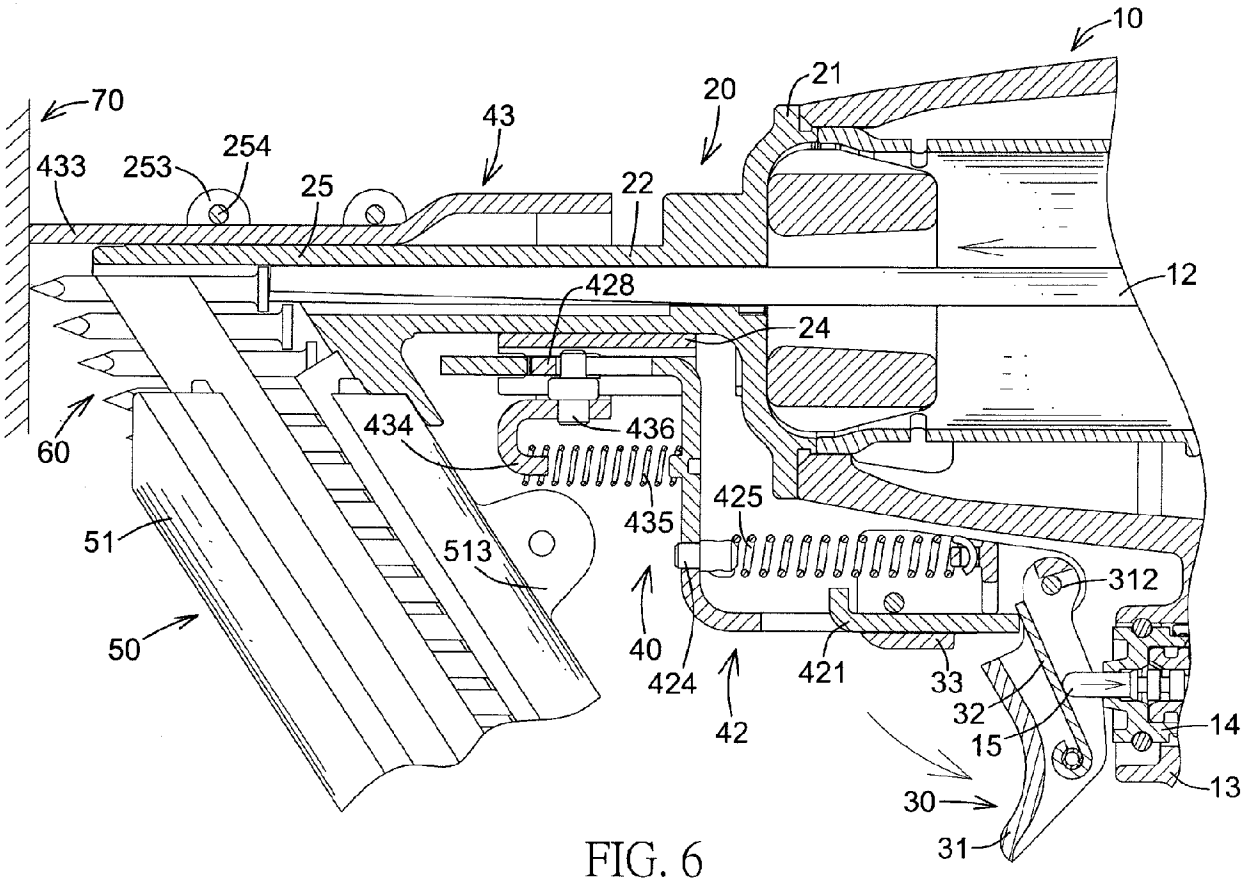
FIG. 6 is an operational side view in partial section of the nail gun in FIG. 1 in contact with a working surface.

With further reference to FIG. 6, when the safety lever (428) is engaged the switch recess (4281) abuts the safety switch and the abutting beam (433) is pressed by the working surface, the abutting beam (433) slides back and translates this movement through the safety switch to the transmitting beam (42) that slides further into the trigger cover (33) and the trigger end (421) pushes the neck of the trigger arm (32). When the trigger (31) is pressed, the trigger arm (32) pivots against the trigger end (421) of the transmitting beam (42) and presses the actuator (15) into the trigger switch (14) to perform the nailing cycle. When the nail gun is moved away from the working surface, the transmitting spring (425) pushes the transmitting beam (42) and the activating bracket (43) back to default positions.

The nail gun with a safety assembly as described has the following advantages.

1. The safety assembly (40) prevents the nail gun from firing when no working piece (70) is pressed against the activating bracket (43), so the nail gun is safe.

2. When four fastening devices (60) remain in the magazine guide groove (512), the positive stop (521) will engage with the limiting hole and the magazine follower (52) cannot push the fastening devices (60) to the breach groove (252) any more. This can remind the person to feed new fastening devices (60) into the magazine guide groove (512).

3. The safety assembly (40) further has another safety function that prevents the nail gun from firing unless the safety lever (428) is pressed.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A nail gun used with fastening devices having a body having a front;

a handle being defined on and protruding transversely from the body and having an external surface;

a trigger end being formed adjacent to the body; and a power supply end; and a chamber being defined longitudinally inside the body and communicating with the power supply end of the handle;

a drive device being mounted in the chamber of the body;

a plunger being connected to the drive device and mounted slidably in the chamber and having an outer end extending out of the body;

a trigger mounting bracket being formed on, protruding from and connecting to the body and having two sidewalls;

two mounting holes being formed through the sidewalls of the trigger mounting bracket and aligned with each other; and two pivot rod holes being formed through the sidewalls of the trigger mounting bracket near the handle and aligning with each other;

a trigger switch being mounted in the trigger mounting bracket, being connected to the drive device and having a central hole; and an actuator being movably mounted in the central hole of the trigger switch;

a breach assembly being connected securely to the front of the body and having a mounting bracket being attached securely to the front end of the body;

a barrel being hollow, being formed on and protruding from the mounting bracket and having a proximal end being connected to mounting bracket; and a distal end;

two breach brackets being formed on, protruded from and connecting to the barrel and the mounting bracket, and each breach bracket having a rear end being formed on the mounting bracket beside the barrel;

a front end;

a tracking mount being attached securely to the breach bracket, adjacent to the barrel and having an inner track being formed longitudinally on the tracking mount;

a breach being formed on and protruding from the barrel and the breach brackets and having an external surface;

a bottom;

a top;

an ejection hole being defined though the breach, communicating concentrically with the barrel and being mounted around the outer end of the plunger;

a breach groove being formed parallel with and through the bottom of the breach and communicating with the ejection hole;

multiple guiding cylinder mounts being formed on and protruding from the external surface near the top of the breach in pairs and being aligned longitudinally on the breach assembly; and multiple guiding cylinders being respectively attached transversely between two corresponding guiding cylinder mounts at the top of the breach;

a triggering device being mounted in the trigger mounting frame, being used to activate the trigger switch and having a trigger cover being mounted securely between the sidewalls of the trigger mounting bracket and having a bottom;

a front;

a rear being defined adjacent to the trigger switch and having an inner surface; and an outer surface;

two rear protrusions being formed on and protruding from the outer surface of rear of the trigger cover;

two pivot rod holes being formed through the protrusions of the trigger cover and aligning with each other;

a through hole being formed through the rear of the trigger cover;

a spring mounting protrusion being formed on and protruding from the inner surface of the rear of the trigger cover;

two mounting holes being respectively formed through the front of the trigger cover, being aligned with the mounting holes in the sidewalls of the trigger mounting bracket; and a mounting rod being mounted securely through the mounting holes of the trigger cover and the mounting holes of the trigger mounting bracket;

a trigger being pivotally mounted in the trigger mounting bracket, aligning with the actuator and having a pivotal end being connected pivotally to the sidewalls of the trigger mounting bracket;

a distal end;

an internal chamber;

two pivot rod holes being formed transversely through the trigger at the pivotal end and aligning with the pivot rod holes in the sidewalls of the mounting bracket;

a pivot rod being mounted pivotally through the pivot rod holes of the trigger mounting bracket, the pivot rod holes of the trigger cover, and the pivot rod holes of the trigger;

a distal pin hole being formed transversely through the trigger at the distal end; and a pivot pin being mounted transversely in the distal pin hole and in the internal chamber of the trigger; and a trigger arm being pivotally connected to the pivot pin in the internal chamber of the trigger and having a neck abutting the actuator; and a gudgeon being formed on and protruding from the neck of the trigger arm and being mounted around the pivot pin of the trigger;

a safety assembly being slidably mounted on the breach assembly and connected to the triggering device and having a transmitting beam being slidably mounted in the trigger cover and the tracking mount and having an inner surface;

an outer surface;

an anchor bolt being connected to the transmitting beam on the inner surface and facing the spring mounting protrusion of the trigger cover;

a transmitting spring being attached between the anchor bolt of the transmitting beam and the spring mounting protrusion of the trigger cover;

a spring mount being formed on the outer surface of the transmitting beam above the anchor bolt;

a trigger end being formed on and protruding perpendicularly from the inner surface of the transmitting beam, being mounted slidably in the trigger cover between the mounting rod and the bottom of the trigger cover, extending through the through hole of the trigger cover and abutting the neck of the trigger arm; and a tracking end being formed on and protruding perpendicularly from the outer surface of the transmitting beam, being slidably mounted in the inner track of the tracking mount and having a distal end;

a safety recess being formed in the tracking end of the transmitting beam and communicating with the inner track of the tracking mount; and a safety lever being mounted in the tracking mount between the inner track and the safety recess, and having a switch recess formed through the safety lever and communicating with the safety recess; and an activating bracket being mounted slidably between the guiding cylinders and the top of the breach and having a mounting end;

a connecting bracket being formed on and protruding from the mounting end of the activating bracket, being slidably mounted around the barrel and connecting to the tracking mount;

a spring hook being formed on and protruding from the connecting bracket and aligning with the spring mount on the transmitting beam;

a minor spring being connected to the connecting bracket and the transmitting beam between the spring hook and the spring mount; and a safety switch being rotatably mounted in the connecting bracket, and to the spring hook and between the switch recess of the safety lever and the safety recess of the transmitting beam; and an abutting beam being formed on and protruding from the active end of the activating bracket, being connected to the connecting bracket above the breach, extending between the guiding cylinders and the top of the breach and having an active end that extends past the breach; and a magazine being connected to the breach assembly and having a magazine frame being detachable connected to the breach and having a bottom;

a top being mounted in the bottom of the breach;

a magazine guide groove being formed in the magazine from from the bottom to the top and communicating with the breach groove in the breach; and a magazine spring; and a magazine follower being mounted slidably in the magazine guide groove of the magazine frame and being connected to the magazine spring.

2. The nail gun as claimed in claim 1, wherein the handle further has a magazine mount being formed on the external surface of the handle near the power supply end; and the magazine frame further has two mounting wings being formed on the magazine frame near the bottom and aligning with the magazine mount of the handle.

3. The nail gun as claimed in claim 1, wherein one of the breach brackets further has a service cover detachably connected to the breach bracket.

4. The nail gun as claimed in claim 3, wherein the tracking end further has a limiting arm being formed on and protruding from the distal end of the tracking end, extended out the service cover and aligning with the external surface of the breach near the bottom to form a limiting hole; and the magazine follower further has a top end; and a positive stop being formed on the top of the magazine follower and aligning with the limiting hole between the limiting arm and the breach.

* * * * *